United States Patent [19]

Jährig et al.

[11] 4,221,944

[45] Sep. 9, 1980

[54] DRIVING APPARATUS FOR ELECTRIC POWER CIRCUIT BREAKERS WITH RECTANGULAR HOUSING

[75] Inventors: Siegfried Jährig; Reinhard Liebig, both of Berlin, Fed. Rep. of Germany

[73] Assignee: Siemens Aktiengesellschaft, Munich, Fed. Rep. of Germany

[21] Appl. No.: 943,927

[22] Filed: Sep. 20, 1978

[30] Foreign Application Priority Data

Sep. 20, 1977 [DE] Fed. Rep. of Germany ..... 2742773

[51] Int. Cl.[3] ..... H01H 9/02

[52] U.S. Cl. ..... 200/303; 200/153 SC

[58] Field of Search ..... 200/303, 153 SC, 153 G, 200/67 PK; 185/37; 220/352

[56] References Cited

U.S. PATENT DOCUMENTS

| | | | |
|---|---|---|---|
| 669,951 | 3/1901 | Woodruff | 220/352 |
| 1,418,558 | 6/1922 | Getchell | 200/153 G |
| 4,152,562 | 5/1979 | Kohler et al. | 200/153 SC |

*Primary Examiner*—John W. Shepperd

*Attorney, Agent, or Firm*—Kenyon & Kenyon

[57] ABSTRACT

A driving apparatus for electric power circuit breakers is disclosed which has a substantially rectangular two-part housing. One part of the housing serves to support and hold the drive parts, among which especially shafts, springs, levers and similar parts are to be counted. This part of the housing has a rectangular basic shape in the form of a tray and is designed as a small, light supporting housing part. In the driving apparatus according to the invention, the cover function is assumed by a light plastic part, which functions as protection for the drive parts and therefore is very light.

6 Claims, 3 Drawing Figures

3
61
65
7
1
2
54
8
55
43
56
60
51
62
5
64
63

DRIVING APPARATUS FOR ELECTRIC POWER CIRCUIT BREAKERS WITH RECTANGULAR HOUSING

BACKGROUND OF THE INVENTION

This invention relates to a driving apparatus for electric power circuit breakers having a substantially rectangular two-part housing one part of which serves to support and hold the drive parts and the other part of which forms the cover for the first part. Driving structures of this type, such as are described, for instance, in the German Auslegeschrift No. 15 40 439, are used primarily for medium-voltage power circuit breakers. They are, in general, three-pole breakers having three upright pole columns arranged side by side and fastened to the driving apparatus by means of pin-type insulators. Between the pin insulators and the driving apparatus, profiled sections, bars or similar parts may be provided for mechanical stiffening of the arrangement.

If the electrical switching capacity of a power circuit breaker of the type described is to be increased, greater mechanical driving energy is required because larger mechanical masses must be accelerated in the switching process. The use for this purpose of methods generally known in the art for scaling up the structure results, however, in enlargement of the driving structure in proportion to the larger driving energy. To avoid such enlargement and so, also, the greater weight of the driving apparatus, materials of greater strength may be used; the springs, shafts and latches may then be made with the same dimensions while accommodating the higher stresses. This undesirably increases the cost of the driving structure, however.

It is an object of the invention to avoid, at least in part, the increase in weight and costs accompanying an increase of the capacity of a circuit breaker driving apparatus of the present type by means of a novel structure.

BRIEF SUMMARY OF THE INVENTION

According to the invention, this problem is solved by limiting the strength of the base part of the housing to that needed to resist the forces exerted by the driving elements; thus, the designed strength of the base part should not exceed the maximum force exerted by the driving elements, within the limits of good engineering practice. In accordance with this teaching of the invention, substantially smaller dimensions are obtained than in the customary structures such as are described in the already mentioned German Auslegeschrift No. 15 40 439 or in the journal CEG-Berichte, April/July, 1960, pages 61 to 66. This also reduces the weight accordingly.

It is preferred that both parts of the housing take the form of trays, with the second housing part serving only to function as protection. For this purpose, the second housing part, called a hood in the following, can be made of thin metal or a suitably plastic.

It is a feature of the invention that some of the drive parts, such as springs or levers, project or protrude from the first housing part. This feature of the new driving apparatus has the added advantage of being very useful for instalation, servicing and repair, since it provides easy access to the driving elements which has not been possible heretofore. Designing the second part as a cover without support functions has a similar effect;

it can be made of a thin-walled metallic material or plastic of low specific gravity.

It has been found in practice that advantageous working relationships are obtained if the depth of the first part of the housing is about one-third and the depth of the second part about two-thirds of the depth of the housing. Thus, after the second housing part is removed in the manner indicated, access to the driving elements exists not only as if there were an opening in the housing, but essentially as though the driving elements were free-standing.

BRIEF DESCRIPTION OF THE DRAWINGS

The invention will be explained in greater detail below with the aid of an embodiment shown in the drawings in which.

DETAILED DESCRIPTION OF THE INVENTION

Figure 1:
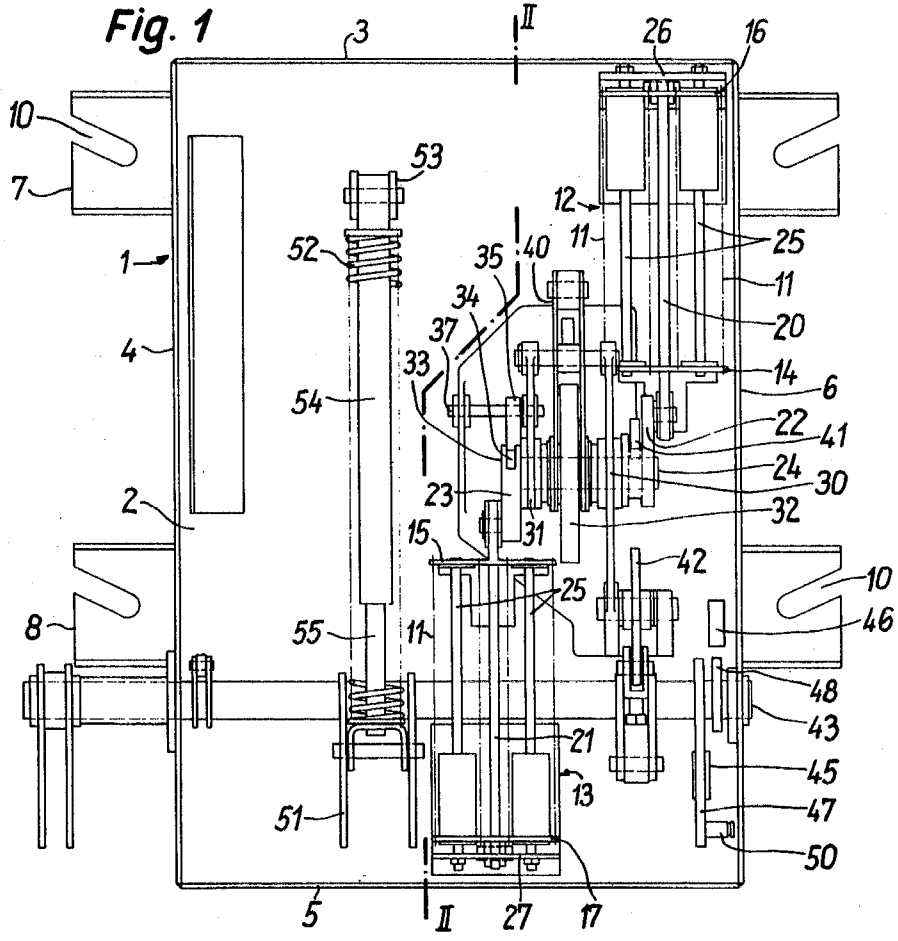
FIG. 1 shows a plan view of a driving apparatus for an oilless, medium-voltage power circuit breaker with the hood left off.
Figure 2:
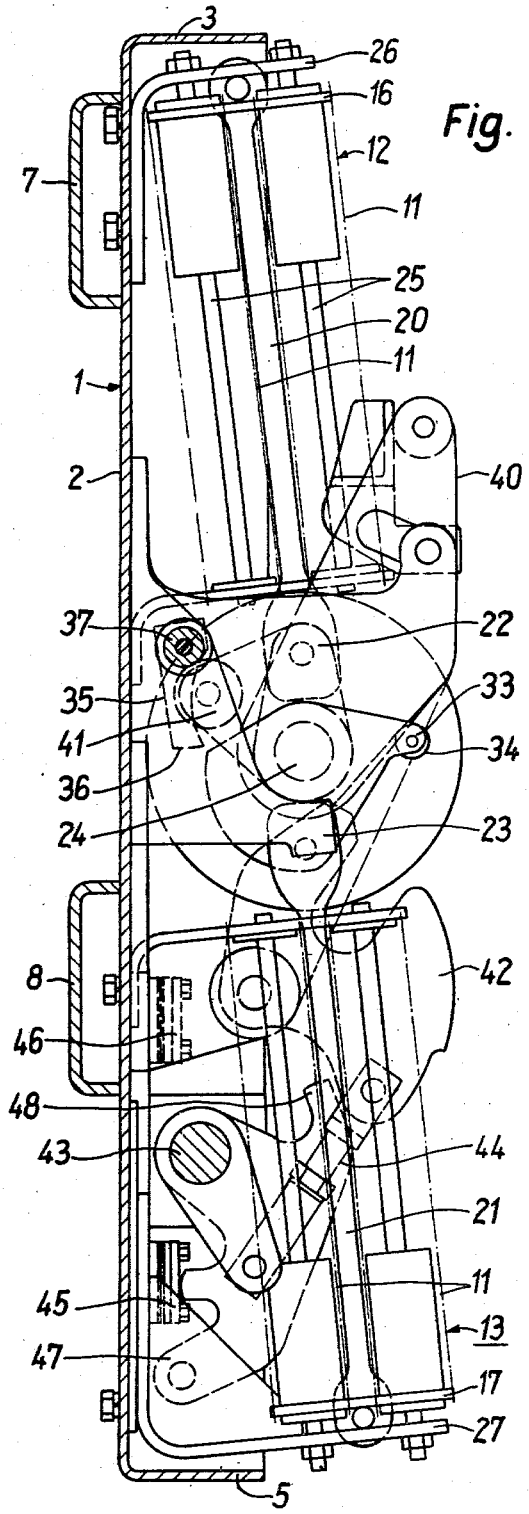
FIG. 2 shows a view in cross-section of the circuit breaker in FIG. 1 taken along the line II—II in FIG. 1.

Reference is made to FIGS. 1 and 2 in which the supporting housing part or base 1, of basically rectangular shape, is seen to take the form of a tray; it thus has a flat bottom 2 as well as four side walls 3, 4, 5 and 6. As was indicated above, the housing 1 is made of a strength in keeping with the purpose of supporting the breaker parts during circuit breaking and resetting operation. It can be made of sheet steel and its stiffness can be increased by welded seams at the joints of the side walls 3, 4, 5 and 6. The insulator support channels or sections 7 and 8 also contribute to the body stiffness, being welded to the bottom 2. These sections serve as supports for insulators on which the pole columns of the power circuit breaker are mounted. For this purpose, the sections 7 and 8 extend beyond the side walls 4 and 6 of the base 1 and are provided with diagonal cutouts 10. For other pole column spacings, the dimensions of the sections may, of course, differ from those shown in FIG. 1.

For purposes of simplicity, a showing of the complete power circuit breaker has been omitted from this description. The arrangement of the drive, the support insulators, and the pole columns is well known in the art and can be found, for example, in the above-mentioned German Auselegeschrift No. 15 40 439.

The driving apparatus uses the principle of the spring accumulator drive. It comprises two groups 12 and 13 of four coil springs 11, each, braced, on the one hand, against stationary abutments 14 and 15 and, on the other hand, against movable abutments 16 and 17. The abutments 16 and 17 are each connected via tie rods 20 and 21, respectively, to crank arms 22 and 23 of a cocking shaft 24. The coil springs 11 and their movable abutments 16 and 17 travel on guide rods 25 which extend between the stationary abutments 14 and 15 and associated support brackets 26 and 27.

In the drawings, the coil springs 11 are shown in released position. It can be seen from FIG. 2 that the longitudinal axis of each spring arrangement makes an angle of a few degrees with the bottom of the housing 1 and that the mounting brackets 26 and 27 accordingly have different configurations. By putting the spring arrangement at an angle, space needed in the lower part of the driving apparatus for accommodating other parts is provided.

Starting with the position shown, the cocking shaft 24 can be turned step by step in its bearings 30 and 31 by a ratchet wheel 32 fastened thereon until a lever 33, also fastened on the cocking shaft 24, comes to rest with the roller 34, attached to its end, against a stop surface 36 of a pivoted stop lever 35. When at rest against the stop surface 36, the roller 34 is positioned a short distance past the dead center position of the cocking shaft with respect to the forces of the springs 11. When so cocked, the cocking shaft 24 may be released by rotation of the stop lever 35, by means of the release shaft 37, until the roller 34 slides off the stop surface 36.

The stepwise rotation of the ratchet wheel 32 can be accomplished either by a push ratchet which can be moved back and forth by a motor (not shown) or by the cocking lever 40, which is mounted on the cocking shaft 24 and can be pushed by a rod (not shown).

When the cocking shaft 24 is unlatched, the force of the springs 11 is released and transmitted by a roller 41 carried on the crank arm 22 of the cocking shaft 24 and a rocker arm 42 through adjustable coupling link 44 to a breaker shaft 43. Breaker shaft 43 extends over the entire width of the supporting housing part 1 and is journaled in the side walls 4 and 6. Rotation of the breaker shaft 43 is limited by stops 45 and 46, against which lever ends 47 and 48, fastened on the breaker shaft 43, can make contact. The lever 47 is at the same time provided with a connecting post 50, to which an electrically insulated drive rod for one of the pole columns of the power circuit breaker may be connected in a manner well known in the art.

Figure 3:
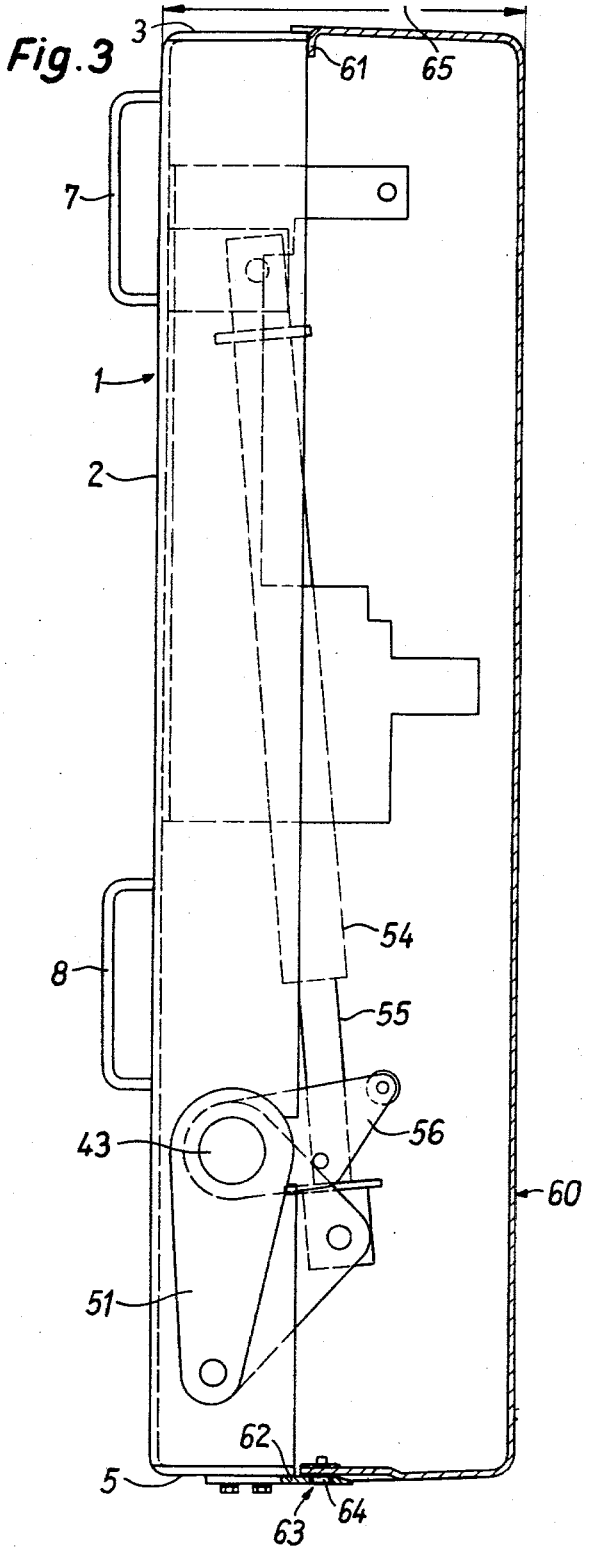
FIG. 3 shows a side view of the driving apparatus including the covering hood, with part of the hood cut away.

The breaker shaft 43 carries another crank arm 51 which engages one end of opening spring 52; the other end of spring 52 is braced against a stationary abutment 53 (FIGS. 1 and 3). The opening spring 52, which is a coil spring working in compression, is supported by telescoping guide rods 54 and 55. The opening spring 52 is cocked during the above-described closing motion by rotation of the breaker shaft 43; it is held in the cocked condition by a latching arrangement on the breaker shaft 43. This latching arrangement consists of a roller lever 56 mounted on the breaker shaft 43 and a stop (not shown) which can be released in the customary manner by automatic tripping devices or by hand.

This driving apparatus is capable of performing a so-called short interruption, i.e., the immediate switching sequence, off-on-off. Thus, in the initial closed position, the opening spring 52 and the closing spring 11 are cocked, provision being made in a manner already known in the art for activation of the automatic cocking device immediately after the release of closing springs 11. Therefore, actuating the tripping shaft 37 immediately after opening is exerted results in closing the breaker and simultaneously cocking the opening spring 52. So too, the breaker shaft latch can be released immediately following, whereupon the breaker is opened again.

The drive parts accommodated and supported in the supporting housing 1 are covered, as shown in FIG. 3, by a hood 60, which may be made of a thin-walled metallic material or a suitable plastic. At several points on the hood 60, portions of the wall of the hood are turned in to form lips or extensions 61 which bear against appropriate edges of the side walls of the supporting housing part 1 and so position the hood 60 on the housing part 1. Tabs 62, provided with openings 63, are attached to the housing 1; the openings 63 are adapted to receive and engage projections 64, arranged near the edge of the hood 60. The material of the hood 60 is elastically deformable in the areas of these projections 64 so that the hood can be sprung onto the tabs 62. Other fastening means well known in the art may, of course, be provided.

As FIG. 3 best shows, the separation line between the supporting housing base or part 1 and the hood 60 is parallel to the bottom surface of the housing; the overall depth (indicated by the dimensioning arrow marked 65) of the driving apparatus housing is subdivided approximately in the ratio 1:2; i.e., about one-third of the depth is provided by the supporting housing part or base 1 and two-thirds of the depth by the hood. The supporting housing part thus provides only the strength necessary to accommodate the drive parts; the cover is a hood adapted for use as a cover only. With this construction of the supporting housing part, the drive parts protrude beyond the contours of the base so that they are highly accessible from all sides, facilitating the production assembly of the parts as well as later inspection and maintenance.

What is claimed is:

1. A driving apparatus for medium voltage electric power circuit breakers comprising a substantially rectangular two-part housing, one part of which supports and holds the circuit breaker drive parts including one end of a spring accumulator and a separate shaft which is driven by the other end of the accumulator and the other part of which forms a cover for the first part, said first part having, as the principal supporting structure for the breaker drive parts, a tray-like rectangular housing having a back, four side walls, and a pair of transverse channel members fixed to and extending across at least the width of the back of the housing and serving as insulator supports, and said first part having a mechanical strength no greater than that required to withstand the forces exerted on it by the drive parts.

2. A driving apparatus in accordance with claim 1, in which both housing parts are approximately tray shaped and in which the second part serves only to protect the drive parts.

3. A driving apparatus in accordance with claim 1 in which the depth of the first part is approximately one-third and the depth of the second part is approximately two-thirds of the depth of the housing and the greatest height of at least one drive part is nearly equal to the depth of the housing, whereby a substantial portion of the drive part projects from the first part and is laterally excessible when the second part is removed from the first part.

4. A driving apparatus for medium voltage electric power circuit breakers comprising a substantially rectangular two-part housing having a base part serving as the support for and sustaining the drive forces of, a number of separate circuit breaker drive parts including spring accumulator drive means, pole column insulators, and a breaker shaft, and having a cover part for enclosing the drive parts, said housing being divided so that the depth of the base part is approximately one-third and the depth of the cover part is approximately two-thirds of the depth of the housing, said base part having a bottom, four side walls, U-shaped supports welded across the outside of the bottom and extending beyond the side walls for holding pole column insulators and forming box-like strengthening members with the bottom, means in the walls of the base part for rotatably mounting the breaker shaft, said base part having a mechanical strength limited to that required to withstand the forces exerted on it by the drive parts, fastener elements disposed near the edges of the walls, and said cover part having inwardly turned extensions adapted to rest against the walls of the base part and projections for engaging the fastener elements on the base part.

5. A driving apparatus for medium voltage electric power circuit breakers comprising:

a substantially rectangular housing having a cover part and a support part, the support part being tray-like in shape, having a back and four side walls joined by welded seams and having a depth which is approximately one-third the total depth of the housing when the cover part, also tray-like in shape, is assembled thereto;

a pair of channel members welded across the back of the support part and contributing to the strength thereof, and having ends projecting beyond the back to serve as insulator supports;

a number of circuit breaker drive parts independently mounted on the support part and transmitting the forces of energy storage and drive actuation thereto, the drive parts comprising a cocking shaft, drive spring mounting means for supporting drive springs coupled to the cocking shaft, means for transmitting motion of the cocking shaft to a circuit breaker drive shaft, a circuit breaker drive shaft journalled in the side walls and coupled to the motion transmitting means, and means supporting a spring which is coupled to, and turns, the drive shaft; and the support part having a strength no greater than that required to withstand the forces exerted on it by the drive parts.

6. The circuit breaker driving apparatus of claim 5 in which substantial portions of the drive parts mounted in the support part project outwards beyond the walls thereof and are accessible from the sides when the cover part is removed.

* * * * *